United States Patent [19]

LaBate

[11] Patent Number: 4,471,950

[45] Date of Patent: Sep. 18, 1984

[54] EXPANDABLE, CONSUMABLE STOPPER PLUG FOR STEEL MAKING AND HANDLING VESSELS

[76] Inventor: Micheal D. LaBate, 115 Hazen Ave., Ellwood City, Pa. 16117

[21] Appl. No.: 436,018

[22] Filed: Oct. 22, 1982

[51] Int. Cl.[3] ..... C21B 7/12

[52] U.S. Cl. ..... 266/272; 266/45; 266/271

[58] Field of Search ..... 266/45, 272, 271, 44; 222/597

[56] References Cited

U.S. PATENT DOCUMENTS

| | | | |
|---|---|---|---|
| 3,124,854 | 3/1964 | Dore | 266/272 |
| 3,398,945 | 8/1968 | Walpole | 266/272 |
| 3,540,627 | 11/1970 | Armstead | 266/272 |
| 4,010,936 | 3/1977 | Takashima | 266/45 |
| 4,030,709 | 6/1977 | Shepard et al. | 266/45 |

*Primary Examiner*—L. Dewayne Rutledge
*Assistant Examiner*—S. Kastler
*Attorney, Agent, or Firm*—Harpman & Harpman

[57] ABSTRACT

A stopper plug for sealing the tap hole of a molten metal receptacle is formed of refractory materials, fibrous substances, and consumable-disintegrable materials in a hollow conical plug that is expandable in a tap hole by movement of a wedge-shaped member therein, the expanded stopper plug being capable of effectively sealing the tap hole for a predetermined time.

6 Claims, 4 Drawing Figures

EXPANDABLE, CONSUMABLE STOPPER PLUG FOR STEEL MAKING AND HANDLING VESSELS

BACKGROUND OF THE INVENTION (1) Field of the Invention

This invention relates to plugs for sealing the flow of metal from molten metal receptacles such as steel making furnaces, ladles, and the like.

(2) Description of the Prior Art

Prior art devices of this type have relied on a number of different plugs or stoppers. See for example U.S. Pat. Nos. 3,540,627, 4,010,936 and 4,030,709.

In U.S. Pat. No. 3,540,627, a conical metal plug is attached to the end of a supporting rod and has a conical pad positioned thereover, the conical pad being formed of a layer of refractory fibers, such as alumina silica fibers, and a layer of glass fibers, the metal plug and its conical pad being insertable in the passageway defined by a tap hole in a molten metal receptacle.

U.S. Pat. No. 4,010,936 discloses a stopper plug in a shape corresponding exactly to the shape of the tap hole and formed on non-porous refractory material, organic fibrous substance, and inorganic fibrous substance together with a combustible substance, the material forming a porous molding which is elastic and capable of shrinking and deformation so that it will remain in the tap hole of the vessel under nominal pressure of the molten metal and will deform and be extruded from the tap hole by the increasing pressure of the molten metal when the vessel is tilted.

U.S. Pat. No. 4,030,709 discloses the use of a ceramic plug in the shape of a hollow cone over a solid backing plug which is maintained in place until the molten metal solidifies against the plug to seal off the tap hole.

The present invention discloses a novel, expandable, hollow cone-shaped stopper plug and a wedge-shaped member movable therein to expand the same in the tap hole of a molten metal receptacle so as to effectively seal the tap hole for a predetermined time.

SUMMARY OF THE INVENTION

An expandable, consumable stopper plug for steel making and handling vessels wherein a blunt nosed hollow refractory plug is formed of fibrous refractory materials, clay-like refractory materials, consumable materials and a suitable binder to form an expandable, stretchable and deformable plug having means for expanding and deforming the same movably arranged therein.

DESCRIPTION OF THE PREFERRED EMBODIMENT

Figure 4:
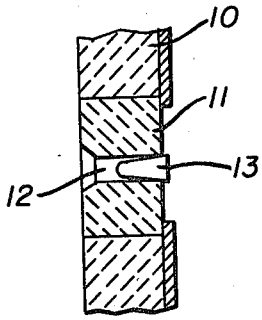
FIG. 4 is a section through a wall of a molten metal receptacle and a tap hole therein showing the stopper plug therein.

Referring to FIG. 4 of the drawings, a portion of a molten metal receptacle 10 may be seen having a tapping block 11 therein defining a cylindrical orifice 12. An expandable consumable stopper plug 13 is shown in expanded position in the cylindrical orifice 12.

Figure 1:
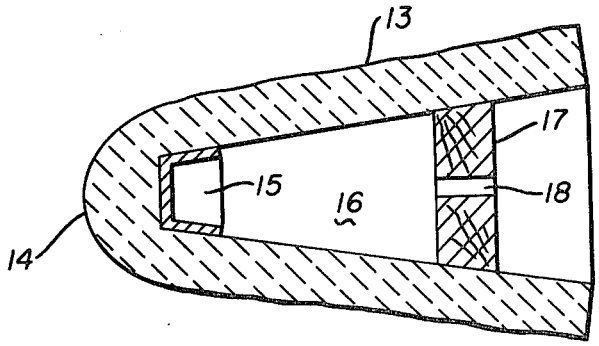
FIG. 1 is a cross sectional side elevation of the stopper plug.

The stopper plug may be seen in FIG. 1 of the drawings to comprise a blunt nosed, hollow, conical body member 13, the nose portion 14 of which is relatively thicker than the wall portions extending therefrom. A steel cap insert 15 is positioned in the cavity 16 defined by the hollow body member 13 and immediately inwardly of and in contact with the material of the blunt nose portion 14 of the stopper plug. A round tapered member 17 having a central aperture 18 therethrough is positioned inwardly of the open end of the hollow body member of the stopper plug and is movable into the cavity 16 toward the steel cap 15 so as to expand and enlarge the hollow body member 13 deforming the wall portions thereof in an action which will securely position the stopper plug in the cylindrical orifice 12 in the molten metal receptacle 10 hereinbefore described.

Figure 2:
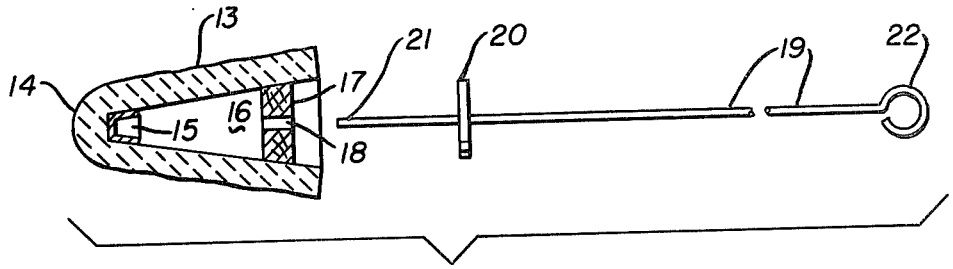
FIG. 2 is an exploded side elevation with parts in cross section and parts broken away showing the stopper plug and a tool for expanding the same.
Figure 3:
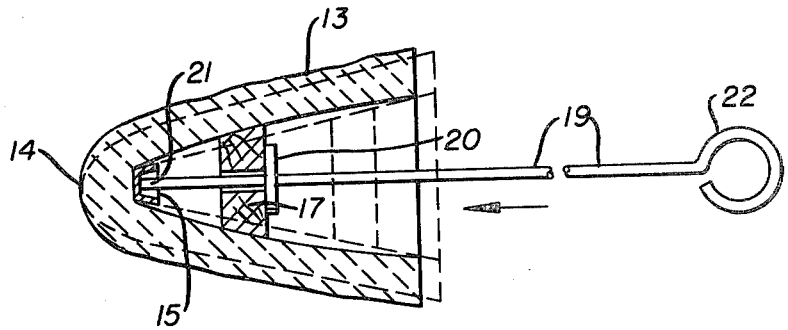
FIG. 3 is a cross sectional side elevation of the expandable stopper plug and the tool for expanding the same with broken lines showing the plug and tool in non-expanded relation and solid lines showing the plug and tool in expanded relation.

In order that the hollow body member 13 forming the stopper plug may be quickly and efficiently expanded in sealing relation to a tap hole or the like, an applicator rod 19 is provided as best seen in FIGS. 2 and 3 of the drawings, the applicator rod 19 having a metal disc 20 positioned thereon inwardly of an end 21 of the rod 19, the other end of the rod 19 being preferably provided with a suitable handle configuration 22.

The length of the rod 19 between the metal disc 20 and the end 21 is predetermined so that upon the end 21 of the rod 19 being positioned through the central orifice 18 in the round tapered member 17 and moved toward the steel cap 15, the metal disc 20 will engage the round tapered member 17 and move it inwardly of the hollow body member 13 to the position shown in solid lines in FIG. 3 of the drawings so as to distort and expand the hollow body member 13 until the end 21 of the applicator rod 19 reaches the steel cap 15 whereupon any further movement imparted the applicator rod 19 will distort the material of the blunt nose 14 of the hollow body member 13 and limit the movement of the round tapered member 17 and the expansion and distortion of the hollow body member 13.

It will thus be seen that the expandable, consumable stopper plug is moved into the tap hole and distorted and expanded by the wedging action imparted to the hollow body member of the plug by the round tapered member 17 as it is moved by the applicator rod 19 which is then removed.

In order that the hollow body member 13 of the stopper plug will retain its desirable consistency and hot metal stopping properties for a predetermined period of time, it is preferably formed of material comprising a mixture of fibrous refractory material such as FIBERFRAX as described in U.S. Pat. No. 3,124,854, or CERAFELT, a product of Johns-Manville Company, in a range of approximately 8% by weight to approximately 25% by weight. These are alumina-silica fibers, dolomite in a range of approximately 32% to approximately 64% by weight, sodium silicate in a range of approximately 8% by weight to 16% by weight, and sawdust in a range of approximately 18% by weight to 27% by weight.

The material from which the stopper plug is formed is completely mixed to a uniform consistency which is essential in the expanding and distortion of the material when the plug is inserted in the tap hole and expanded as hereinbefore described.

In addition to the materials above mentioned, mineral wool, such as blast furnace slag fibers may be incorporated and silica, quartz, magnesia, olivine, mullite, aluminum oxide, chamotte, magnesite or perlite may be incorporated with the dolomite or in place of the same. Resin binders, such as phenol-formaldehyde resins, urea-formaldehyde resins, and furan resins may be used in place of the sodium silicate, all in substantially the same proportions. Other combustible substances such as paper pulp and wood flour may be used in addition to the sawdust and/or in place of same, again in substantially the same proportions. It is essential that the proportions of the dolomite or its alternate substances be sufficient in any of the mixtures to insure the desirable consistency of the material from which the hollow body member 13 of the stopper plug is formed so as to enable it to be deformed and expanded as hereinbefore described.

It will be recognized that the proportions of combustible and/or disintegrable materials are such that the life of the stopper plug when subjected to molten metal can be readily predetermined. The consistency and/or density of the material also comprises a factor in determining the life expentancy of the plug when subjected to molten metal.

As disclosed herein the stopper plug is formed of the hereinbefore disclosed materials so as to have a predetermined life whereupon the consumable and/or disintegrable or combustible materials incorporated therein will react and/or oxidize to weaken or change including disintegration of the material of the plug so as to open the tap hole which has been sealed thereby.

It will occur to those skilled in the art that tap holes in molten metal receptacles become enlarged by being worn away to irregular configurations by molten metal flowing therethrough. The expandible consumable stopper plug disclosed herein easily accommodates such irregular shaped tap holes as the construction, materials and arrangement of the walls and nose of the plug body distort and expand outwardly as a result of forward pressure applied to the plug in the tap hole as hereinbefore described. The expansion and distortion of the plug thus fills any cavity limited only by the initial diameter measure of the plug itself with the filled tap hole remaining filled for the desired predetermined time whereupon the consumable and/or disintegrable characteristics of the material of the plug act to open the tap hole.

In a typical metal receptacle the tap hole will be found to vary from two to four inches in its initial diameter and the self-expanding consumable stopper plug of this invention is accordingly preferably formed so that the blunt nose is approximately three inches in diameter, the opposite open end of the conical body member thereof being from eight to ten inches in diameter and the walls of the conical body member being approximately two inches thick and the overall length of the expandable, consumable stopper plug being between twenty five and thirty inches.

Those skilled in the art will recognize that these dimensions may be very considerable without affecting the utility, time factor and deformable expandable properties of the stopper plug.

A typical and satisfactory analysis of the refractory materials of which the stopper plug is formed may comprise silican dioxide in an amount between 31% and 36% by weight, calcium dioxide in an amount between 21% and 26% by weight, aluminum oxide in an amount between 11% and 15% by weight, magnesium oxide in an amount between 3% and 6% by weight with the amounts of the several ingredients being sufficient to provide for an ignition loss of from 25% to 28% and wherein the density, pounds per cubic inch, is between 0.0075 lbs, and 0.0105 lbs.

Having thus described my invention what I claim is:

1. An improvement in a stopper plug for sealing a tap hole in a molten metal receptacle for a predetermined time, the improvement comprising forming said plug in a hollow elongated blunt-nosed conical shape and means for expanding said conical shape within said tap hole, said hollow conical shape formed of a refractory material, a fibrous substance and a binder, said means for expanding said conical shape comprising a cross sectionally circular disc member positioned in said hollow conical shape, an opening in the center of said circular member, a rod having a disc thereon, said disc arranged to engage said cross sectionally circular disc member whereby movement of said rod in one direction moves said cross sectionally circular disc member toward said blunt nose and the disc on said rod holds said cross sectionally circular member in transverse relation to said conical shape so as to expand said conical shape into sealing engagement with said tap hole.

2. The stopper plug set forth in claim 1 and wherein the refractory material is at least one of silica, quartz, magnesia, olivine, mullite, aluminum oixde, chamotte, dolomite, magnesite or perlite.

3. The stopper plug set forth in claim 1 and wherein the fibrous substance is at least one of inorganic fibrous substance selected from the group consisting of aluminum silicate, rock wool and slag wool.

4. The stopper plug set forth in claim 1 and wherein the consumable and/or disintegrable material is at least one of a group consisting of paper, sawdust and wood flour.

5. The stopper plug set forth in claim 1 and wherein the binder is at least one of a phenol-formaldehide resin, a urea-formaldehyde resin, a furan resin or sodium silicate.

6. The improvement in a stopper plug for sealing a tap hole in a molten metal receptacle set forth in claim 1 and wherein a metal member is positioned in said hollow, conical shape adjacent said blunt nose so as to limit movement of said rod and disc thereon and said cross sectionally circular body member with respect to said blunt nose of said hollow conical shape.

* * * * *